United States Patent [19]

Thow et al.

[11] Patent Number: 4,883,043

[45] Date of Patent: Nov. 28, 1989

[54] GAS-FIRED ARTIFICIAL LOG FIREPLACE ASSEMBLY

[75] Inventors: Ian Thow, Merseyside, England; Ajay K. Gupta, Cincinnati, Ohio

[73] Assignee: Yale and Valor p.l.c., London, England

[21] Appl. No.: 290,294

[22] Filed: Dec. 27, 1988

[51] Int. Cl.[4] ..... F24C 3/00

[52] U.S. Cl. ..... 126/512; 126/92 AC; 431/125

[58] Field of Search ..... 126/512, 513, 500, 92 R, 126/92 AC, 92 B; 431/125, 110, 112, 328, 329; 40/428

[56] References Cited

U.S. PATENT DOCUMENTS

| | | | |
|---|---|---|---|
| 819,260 | 5/1906 | Whitney | 126/512 |
| 1,017,751 | 2/1912 | Hansen | 126/512 |
| 1,630,109 | 5/1927 | Chandler | 431/125 |
| 2,302,796 | 11/1942 | Oyster | 126/92 AC |
| 3,042,109 | 7/1962 | Peterson | 431/125 |
| 3,696,801 | 10/1972 | Whitehead | 126/92 R |
| 3,760,790 | 9/1973 | Voges et al. | 126/92 R |
| 4,542,735 | 9/1985 | Smith et al. | 126/92 AC |
| 4,573,446 | 3/1986 | Rosick et al. | 126/92 R |
| 4,602,609 | 7/1986 | Wright | 126/92 AC |
| 4,828,485 | 5/1989 | Jankowski | 126/512 |

FOREIGN PATENT DOCUMENTS

| | | | |
|---|---|---|---|
| 532097 | 1/1941 | United Kingdom . | |
| 2169700 | 7/1986 | United Kingdom | 126/512 |
| 2185100 | 7/1987 | United Kingdom | 126/92 AC |

*Primary Examiner*—James C. Yeung

*Attorney, Agent, or Firm*—Wood, Herron & Evans

[57] ABSTRACT

The present invention relates to a gas-fired artificial log fireplace assembly, and more particularly to a gas fireplace assembly which visually simulates, in a realistic fashion, a fire in a fireplace stacked with horizontally disposed artificial logs, and which at the same time supplies substantial space heat to the surrounding room environment.

19 Claims, 2 Drawing Sheets

GAS-FIRED ARTIFICIAL LOG FIREPLACE ASSEMBLY

FIELD OF THE INVENTION

The present invention relates to a gas-fired artificial log fireplace assembly, and more particularly to a gas fireplace assembly which visually simulates, in a realistic fashion, a fire in a fireplace stacked with horizontally disposed artificial logs, and which at the same time supplies substantial space heat to the surrounding room environment.

BACKGROUND OF THE INVENTION

Fireplaces are very popular and desirable in houses and apartments, both for heating as well as for aesthetics. There are two primary types of fireplaces—those in which solid fuels such as wood, coal, coke, peat or combinations thereof are burned (solid fuel fireplaces), and those which burn gas and have simulated solid fuel elements such as, artificial logs, to add an element of realism. Gas fires have the advantage that they do not require manual refueling or clearing of ashes and they are very controllable. Because of the advantages of gas fires, considerable efforts have been made to recreate the appearance of traditional solid fuel fires.

Simulated solid fuel gas fires, that is, those having artificial solid fuel elements such as logs, are known. In general, these consist of a simulated fuel bed which is heated to incandescence by flames, or by the products of combustion of flames, to simulate the visible glowing embers of a solid fuel fire. A principal feature in the aesthetic appeal of real, or traditional, solid fuel fires is the existence of visually perceptible, luminous flames flickering about the main fuel bed. Such flames can be closely mimicked in simulated solid fuel gas fires by burning neat gas, i.e., gas with little or no primary aeration, which produces a yellow flame. Simulated solid fuel gas fires which incorporate this feature in combination with an incandescent or glowing bed are known. Such neat gas flames, like those produced in real or traditional solid fuel fires, are not static or spatially fixed, but move or waver about irregularly or randomly due to the airflow in the fireplace.

U.S. Pat. No. 4,602,609, discloses a simulated solid fuel fireplace having a main heater burner and a plurality of flame effect burners. The flame effect burners burn neat gas (non-aerated) to produce yellow flames, while the heater burner burns a gas-air mixture with a higher air content to produce very hot "blue" flames for space heating purposes. U.S. Pat. No. 4,573,446 also discloses a simulated solid fuel fire which has a neat gas burner for producing visible yellow flames and a main burner for producing blue heat flames.

There is generally incomplete combustion of the neat gas burned in neat gas burners due to the low air-to-gas ratio in the burners. As a result of the incomplete combustion, carbon monoxide and soot are produced as by-products of the flames. For safety reasons, it is desirable to minimize the production of carbon monoxide and soot in artificial gas fireplaces.

The known gas fireplace assemblies, particularly those featuring horizontally stacked artificial logs, are generally lacking in either the aesthetics of real flame fires or in heat production, or both, as well as producing undesirable by-products due to the incomplete combustion of the neat gas. The present invention addresses the shortcomings of the prior art by providing a very realistic-looking simulated gas fireplace having horizontally stacked artificial logs which radiates a substantial amount of heat to the surroundings and which produces minimal undesirable by-products of combustion.

SUMMARY OF THE INVENTION

A preferred embodiment of the gas fireplace assembly of this invention includes a suitably supported base plate of a refractory material that glows visibly when heated above approximately 1472° F. A first or front artificial log of refractory material is supported in spaced relation above the base plate to define therewith a first elongated generally horizontally disposed chamber section. A second artificial log of refractory material is supported proximal the base plate and spaced rearwardly from the front log to define a second elongated generally vertically disposed chamber section. Both logs are disposed generally horizontally and parallel to each other and to the plane of the opening of the fireplace in which the assembly is disposed, such that the first and second chamber sections cooperate to collectively define an elongated heat chamber having an L-shaped or angled cross section which spans the width of the fireplace.

The preferred embodiment further includes an elongated heater burner extending horizontally forward of and parallel to the front log for directing "blue" flame jets generally rearwardly into the elongated heat chamber. The flames issuing from the heater burner heat to a visible glow, which is at least approximately 1470° F., the bottom and rear surfaces of the front log, and the front surface of the second log. In this way, the aesthetics of red-glowing horizontal logs and underlying embers is simulated while at the same time substantial heat is radiated to the surroundings. The upper surface of the base plate preferably is highly textured to maximize its resemblance to burning embers when appropriately heated. In a preferred form of the invention, both the base plate and the horizontally arranged artificial logs are made of an inorganic alumina silicate (ceramic) fiber material which permits them to be heated to temperatures of approximately 2370° F. or more, thereby further enhancing the heat radiating and aesthetic qualities of the fireplace.

In the preferred embodiment, the horizontal log fireplace assembly also includes a first set of neat gas burners which pass through the front log and emerge from the rear surface thereof for issuing yellow neat gas flame jets upwardly and rearwardly toward the front surface of the second log. The flames issuing from the first set of neat gas burners impinge on the front surface of the second log in a generally tangential direction at the approximate midpoint of the front surface thereof. These flames are visible and give the appearance of burning logs, thereby enhancing the realism and visual aesthetics of the fireplace assembly. The elongated heat chamber defined by the base plate and the front and second logs retains the heat produced by the main burner flame so as to increase the combustion efficiency of the gas issuing from the first set of neat gas burners, thereby reducing the undesirable combustion by-products such as carbon monoxide and soot. The hot gases in the heat chamber causes turbulence, which in turn causes the yellow flames issuing from the first set of neat gas burners to flicker. The glowing base plate and logs and the flickering yellow flames add aesthetic appeal to the horizontal log fireplace assembly of this invention.

The fireplace assembly, in accordance with certain further principles of the invention, further includes two elongated horizontally disposed front burners located proximate the front surface of the front log, preferably embedded in it. These burners cause the front surface of the front log to visibly glow, and thereby enhance the aesthetics and realism of the artificial log fireplace assembly.

In addition, the fireplace assembly may further comprise a third log of refractory material disposed generally horizontally and parallel to the front and second logs, and supported such that it is spaced rearwardly of the second log. Preferably, the base plate is inclined upwardly and rearwardly such that the top of the third log is positioned above the top of the second log, which is in turn positioned above the top of the front log, thus rendering all three logs visible from in front of the fireplace assembly. In the preferred embodiment, there is also included a second neat gas burner disposed between the second and third logs for issuing yellow-color flame jets in a generally upward direction, thereby further enhancing the realism of the horizontally stacked artificial log fireplace.

Further features and advantages of the present invention will become more apparent with reference to the accompanying drawings and the detailed description.

DETAILED DESCRIPTION OF THE PREFERRED EMBODIMENT

Figure 1:
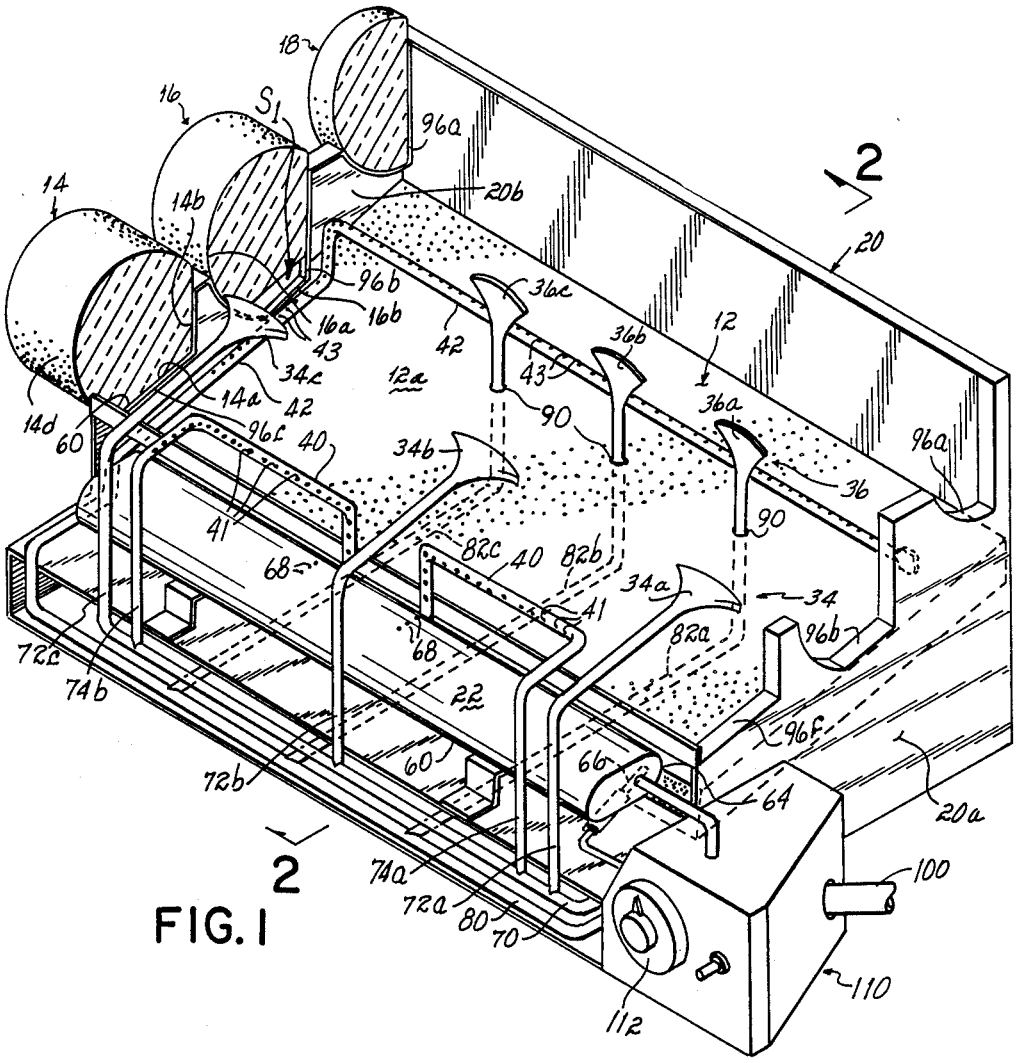
FIG. 1 is a perspective of the preferred embodiment of the fireplace assembly of this invention, with the logs partially broken away.
Figure 2:
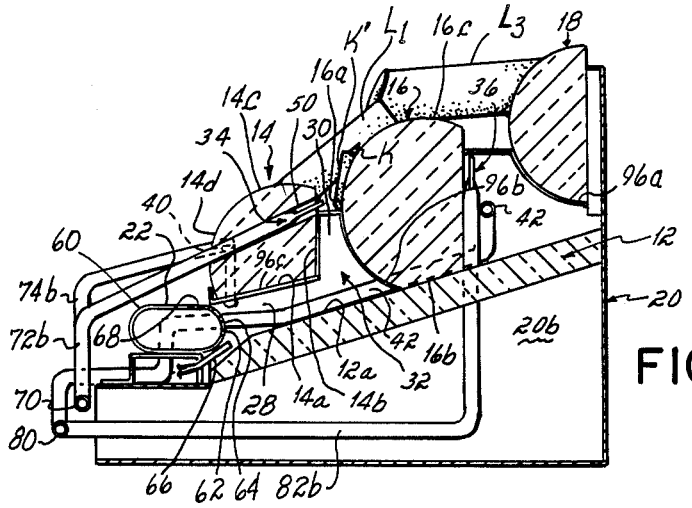
FIG. 2 is a vertical cross-section from front to back of the fireplace assembly of the present invention taken on line 2—2 of FIG. 1.
Figure 3:
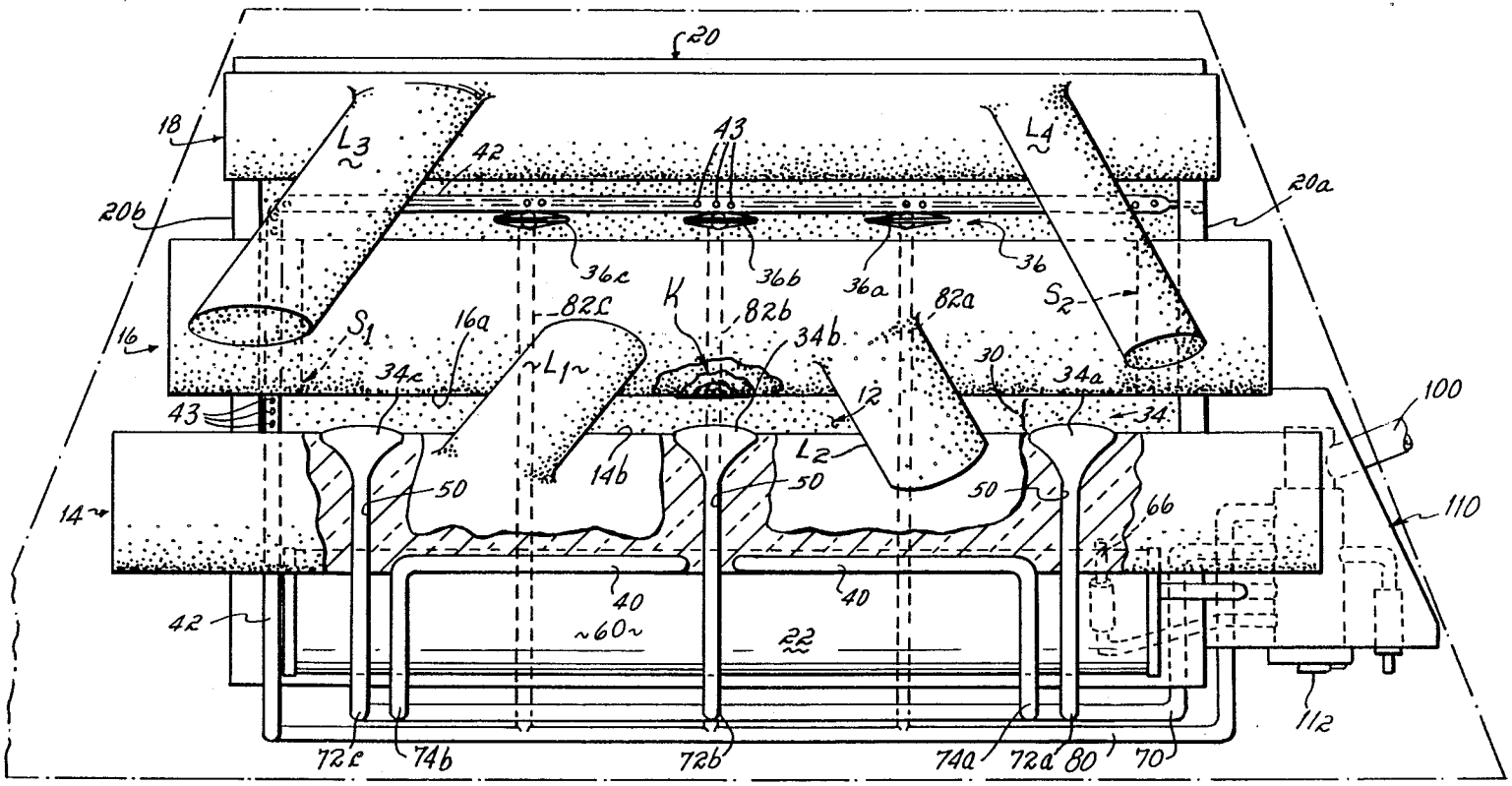
FIG. 3 is a top plan view, partially broken away, of the fireplace assembly of FIG. 1.

In a preferred form, and with reference to FIGS. 1 and 2, the fireplace assembly of the present invention includes a rectangular base plate 12, a first or front log 14, a second or intermediate log 16, and third or rear log 18. Base plate 12 and logs 14, 16 and 18 are supported by support structure 20, which has vertical side plates **20*a* and 20*b*. Vertical side plates 20*a* and 20*b* each have a plurality of notches 96 in their upper edge each of which conforms to the log which it supports. That is, rear notches 96*a* conform substantially to the shape of rear log 18, middle notches 96*b* conform substantially to the shape of middle log 16, and front notches 96*c* conform substantially to the shape of front log 14. Each log 14, 16 and 18 is supported adjacent its opposite ends by vertical side plates 20*a* and 20*b***, respectively, as shown in FIG. 3.

In a preferred form, base plate 12 has a generally planar top surface **12*a*, and front log 14 has generally planar bottom and rear surfaces 14*a* and 14*b*, respectively. The base plate 12 is disposed at a slight angle relative to the horizontal plane so as to position the top surface 16*c* of the second log 16 at a higher vertical level than the top surface 14*c* of the front log 14. The angle is preferably between about 5° and 20°, and optimally is about 12°. Bottom surface 14*a* of front log 14 and top surface 12*a* of base plate 12 converge in the direction of second log 16 such that the distance between those surfaces is approximately 1.25" at a point adjacent front surface 14*d* of front log 14 and is about 1" at a point adjacent rear surface 14*b* of front log 14. Second log 16 is supported by support structure 20 such that its bottom surface 16*b* lies proximal top surface 12*a* of base plate 12 and its front surface 16*a* is spaced apart from rear surface 14*b* of front log 14** a distance of between approximately 0.5" and 1.5", with the distance preferably being approximately 0.8". It should be appreciated that the optimal distances between the logs and base plate of the fireplace assembly will vary depending on the gas flow rate and gas pressure. The above distances are for a gas flow rate of about 22 $ft^3/hr$, and a gas pressure of about 4" $H_2O$ (gauge).

Bottom surface **14*a* of front log 14, top surface 12*a* of base plate 12 and side walls 20*a* and 20*b* of support structure 20 define a first elongated horizontal chamber section 28. Rear surface 14*b* of front log 14, front surface 16*a* of second log 16, top surface 12*a* of base plate 12, and side walls 20*a* and 20*b* of support structure 20 define a second elongated vertical chamber section 30. First and second elongated chamber sections 28 and 30 form an elongated heat chamber 32, which has an angled or substantially L-shaped cross-section, as best shown in FIG. 2. Optimally, the logs are positioned relative to each other and base plate 12 so as to maximize combustion and heat retention in elongated heat chamber 32 and minimize the production of undesirable by-products. The distances between the logs and the base plate, therefore, are an important aspect of the invention. If front and second logs, 14 and 16, respectively, are spaced too close together, combustion is poor due to lack of air in heat chamber 32. If front log 14 and second log 16 are spaced too far apart, heat chamber 32 will not capture the heat from the main burner flame. This is undesirable because heat chamber 32 will be too cool to radiate substantial heat to the surroundings and combustion of the first neat gas burner flames will not be enhanced and thus soot and carbon monoxide production will not be minimized. Side support walls 20*a* and 20*b* contain heat with the chamber 32** that would otherwise escape therefrom were these walls not present.

Fireplace assembly 10 further includes main burner 22 which produces hot "blue" flames that project into heat chamber 32. Main burner 22 consists of a elongated tubular member 60 which extends substantially the width of the base plate 12. Main burner 22 is supported by support structure 20 in front of and below front log 14. Tubular member 60 of main burner 22 has a plurality of gas orifices 62 spaced along substantially the entire length of rear surface 64 thereof. Pilot 66 lights main burner 22 when gas is supplied thereto and flame jets issue from orifices 62 in rear surface 64 of tubular member 60 generally rearwardly into first elongated chamber section 28. The heat from the flames of the main burner 22 and the combustion products thereof, which are at a temperature in the range of approximately 1470° F. to 2030° F., is captured in heat chamber 32 and cause base plate 12, bottom and rear surfaces **14*a* and 14*b* of front log 14 and front surface 16*a* of second log 16 to glow visibly, simulating the glow of burning logs and embers. In addition, the heat from main burner 22 is radiated to provide heat to the surroundings. Main burner 22 also has two rows of flame ports or orifices 68 in the upper surface of tubular member 60. Small flames issue from flame ports 68 when main burner 22** is lit.

In addition to main burner 22, fireplace assembly 10 includes first neat gas burner assembly or means 34, which consists of three neat gas burner nozzles 34a–34c that pass through apertures 50 in front log 14 and which project rearwardly and upwardly from rear surface 14b of front log 14. The three neat gas burner nozzles 34a–34c communicate with first gas line 70 by neat gas burner supply branches 72a–72c. The three neat gas burner branches 72a–72c each pass through a respective aperture 50 in front log 14. The combustion of the gas issuing from the nozzles 34a–34c of the first neat gas burners 34 is enhanced by the substantial heat captured in heat chamber 32.

Fireplace assembly 10 further includes dual front burners 40 which communicate with first gas line 70 by front burner supply branches 74a and 74b. Front burners 40, which are generally tubular, have a plurality of flame ports or apertures 41 in the front surface thereof for issuing flames outwardly from front surface 14d of front log 14. Front burners 40 are located proximal front surface 14d of front log 14 or, preferably, are embedded therein, such that apertures 41 remain visible. When gas is supplied to front burners 40 through front burner supply branches 74a and 74b, the flames issuing from flame ports 68 in main burner 22 ignite the gas issuing from front burners 40. The flames issuing from front burners 40 can be varied from visible yellow flames for aesthetics to hot "blue" flames which cause front surface 14d of front log 14 to glow. The flames are varied by adjusting the gas/air ratio which is supplied to the front burners 40. This can be accomplished by any suitable means, for example, by including air ports in front burner supply branches 74a and 74b, which can be opened or closed to increase or decrease the amount of air in the gas/air mixture.

The preferred embodiment further includes third log 18, which is supported by support structure 20 and is spaced rearwardly from second log 16 a distance of between approximately 1"–1.5". Disposed between second and third logs 16 and 18 are second neat gas burner assembly or means 36, which consists of three burner nozzles 36a–36c. Gas is supplied to burner nozzles 36a–36c of second neat gas burner assembly 36 from second gas line 80 by means of branch supply lines 82a–82c. Branch supply lines 82a–82c pass rearwardly from supply line 80 underneath base plate 12 and project upwardly through apertures 90 in base plate 12 to supply second neat gas burners 36a–36c. Also in communication with second gas line 80 is lighting tube 42, which extends rearwardly from second gas supply line 80 along side wall 20b to a point between second and third logs, 16 and 18, whereupon it makes a 90° bend and then extends substantially the width of the base plate 12 from side support 20b to 20a where it terminates. Lighting tube 42 has a plurality of apertures 43 in its upper surface from which gas issues. The flame from main burner 22 ignites lighting tube 42 when it is supplied with gas, and lighting tube 42 in turn ignites the second neat gas burners 36a–36c. Because the gas supply to lighting tube 42 and burners 36a–36c are independent, the gas/air mixture supplied to burners 36a–36c is variable and those burners may produce yellow flames for aesthetics or "blue" flames for additional heating. Preferably, a yellow flame is desired. Any suitable means may be included for adjusting the flames from burners 36a–36c; for example, branch supply lines 82a–82c may have air ports which can be opened or closed incrementally to change the gas/air ratio fed to the burners 36a–36c.

In all embodiments of the present invention there is included a gas flow regulator 110 for controlling the gas supply to fireplace assembly 10. In a preferred embodiment of the invention which includes front, second and third logs 14, 16 and 18, main burner 22, front burner 40, and first and second neat gas burners 34 and 36, gas flow regulator 110, which is connected to main gas supply line 100, has a control knob 112 with five operational settings. In a first setting, the off position, no gas flows to the fireplace assembly 10 and it is non-operational. In a second setting, gas flows from supply line 100 through regulator 110 to pilot 66, which is ignited in any suitable manner, for example, by an automatic spark igniter, or manually with a match. When the control knob 112 is turned to the third setting, gas flows through regulator 110 to main burner 22 and is ignited by pilot 66. With the control knob 112 in the fourth operational setting, gas flows to the front burners 40 and to first neat gas burners 34a–34c, all of which are positively ignited by the flames from main burner 22. When control knob 112 is in the fifth setting, the full-on position, gas is supplied to the second neat gas burners 36 and to lighting tube 42, which is lit by main burner 22 and which in turns lights second neat gas burners 36a–36c. With this type of control, variations in aesthetics and heat output from the fireplace assembly are possible by changing the setting to have more or less burners in operation at any given time.

In the preferred embodiment, branch logs $L_1$ and $L_2$ which span the front and middle logs 14, 16 are provided to restrict the escape of products of combustion from between the logs. This increases the heat trapped between the logs, in turn increasing the combustion efficiency and temperature on the confronting surfaces of the logs, causing the logs to visibly glow in a more enhanced fashion, which maximizes the realism of the log fire and the space heat provided to the environment.

Branch logs $L_3$ and $L_4$ which span across the tops of logs 16 and 18 are provided for decorative purposes only.

Transverse slots $S_1$ and $S_2$ disposed in the bottom surface 16b of the middle log 16 allow gaseous products of combustion to escape from the combustion chamber 32 to the lower portion of the space between the rear of the second log 16 and the front of the third log 18, whereupon they escape upwardly from between the second and third logs 16 and 18.

A knot K is formed in the front surface 16a of middle log 16 and has a generally planar front surface K' which projects slightly forwardly and upwardly into the combustion chamber section 30 between logs 14 and 16. The knot is heated to a visible red glow and radiates heat to the surrounding space.

The present invention thus provides a gas-fired artificial log fireplace assembly having horizontally disposed logs which can be operated to radiate substantial heat to the surroundings while at the same time providing a very realistic, aesthetically pleasing fire. Particular variations in the arrangement and elements of the gas fireplace assembly of this invention will be obvious to those skilled in the art. The scope of this invention is defined by the appended claims and is not meant to be limited by the various examples herein.

We claim:

1. A fireplace assembly for a fireplace having an opening, comprising:

a support structure;

a base plate of a refractory material that glows visibly above approximately 1470° F., said base plate having a generally planar upper surface and being supported by said support structure;

a front artificial log of refractory material having front, rear, top and bottom surfaces, said front log being supported by said support structure such that said bottom surface of said front log is spaced above said base plate to define a first elongated generally horizontal chamber section;

a second artificial log of refractory material having front, rear, top and bottom surfaces, said second log being supported by said support structure such that said bottom surface of said second log is proximal said base plate and said front surface of said second log is spaced from said rear surface of said front log to define a second elongated generally vertical chamber section, said first and second chamber sections collectively defining an elongated heat chamber having an angled cross-section;

said logs disposed generally horizontally and parallel to each other and to the plane of the opening of the fireplace; and gas burner means supported by said support structure extending along and in front of said front log for directing blue flame jets into said first elongated chamber section toward said second log for heating to a visible glow said bottom and rear surfaces of said front log, said front surface of said second log, and said base plate, whereby substantial heat is radiated to the surroundings and an appearance of glowing logs and underlying embers is provided to enhance the aesthetics of the artificial log fireplace.

2. The fireplace assembly as recited in claim 1 wherein the spacing between said bottom surface of said front log and said base plate is approximately 1", and the spacing between said front surface of said second log and said rear surface of said front log is in the approximate range of 0.5"–1.5".

3. The fireplace assembly as recited in claim 1 wherein said bottom and rear surfaces of said front log are generally planar so as to trap heat in said elongated heat chamber for higher radiant efficiency and higher combustion efficiency.

4. A fireplace assembly for a fireplace having an opening, comprising:

a support structure;

a base plate of a refractory material that glows visibly above approximately 1470° F., said base plate having a generally planar upper surface and being supported by said support structure;

a front artificial log of refractory material having front, rear, top and bottom surfaces, said bottom and rear surfaces being generally planar, said front log being supported by said support structure such that said bottom surface of said front log is spaced above said base plate approximately 1" to define a first elongated generally horizontal chamber section;

a second artificial log of refractory material having front, rear, top and bottom surfaces, said second log being supported by said support structure such that said bottom surface of said second log is proximal said base plate and said front surface of said second log is spaced from said rear surface of said front log between approximately 0.5" and 1.5" to define a second elongated generally vertical chamber section, said first and second chamber sections collectively defining an elongated heat chamber having an angled cross-section;

said logs disposed generally horizontally and parallel to each other and to the plane of the opening of the fireplace; and gas burner means supported by said support structure extending along and in front of said front log for directing blue flame jets into said first elongated chamber section toward said second log for heating to a visible glow said bottom and rear surfaces of said front log, said front surface of said second log, and said base plate, whereby substantial heat is radiated to the surroundings and an appearance of glowing logs and underlying embers is provided to enhance the aesthetics of the artificial log fireplace.

5. The fireplace assembly as recited in claim 1 or 4 wherein said bottom surface of said front log and said upper surface of said base plate converge in a direction toward said second log to channel the heat and combustion products from said main burner into said elongated heat chamber.

6. The fireplace assembly as recited in claim 1, further comprising:

first neat gas burner means for issuing flame jets directed upwardly and rearwardly toward said front surface of said second log to enhance the realism of the fireplace assembly, whereby the radiant heat from said elongated heat chamber enhances the combustion efficiency of the gas from said neat gas burners.

7. The fireplace assembly as recited in claim 6 wherein the flame jets issuing from said first neat gas burners impinge upon said front surface of said second log in a generally tangential direction at the approximate midpoint of said front surface to provide the appearance of said second log burning.

8. The fireplace assembly as recited in claim 1, 4 or 6, further comprising:

elongated, horizontally disposed front burner means located proximal said front surface of said front log for causing said front surface of said front log to visibly glow and thereby enhance the realism of the fireplace.

9. The fireplace assembly as recited in claim 1 wherein said base plate is angled rearwardly and upwardly at a relatively small angle to the horizontal plane to position said top surface of said second log at a higher vertical level than said top surface of said front log such that both front and second logs are visible from the front of a fireplace and give the appearance of a stacked array of horizontal logs.

10. The fireplace assembly as recited in claim 9 wherein said angle is between approximately 5° and 20°.

11. The fireplace assembly as recited in claim 10 wherein said angle is approximately 12°.

12. The fireplace assembly as recited in claim 1 further comprising:

a third artificial log of refractory material having front, rear, top and bottom surfaces disposed generally horizontally and parallel to said front and second logs, said third log being supported by said support structure such that said front surface of said third log is spaced rearwardly from said rear surface of said second log a distance of between approximately 1" and 1.5"; and second neat gas burner means for issuing flame jets generally upwardly disposed between said second and third logs to enhance the realism of the fireplace assembly.

13. A fireplace assembly for a fireplace having an opening, comprising:

a support structure;

a base plate of a refractory material that glows visibly above approximately 1470° F., said base plate having a generally planar upper surface and being supported by said support structure;

a front artificial log of refractory material having front, rear, top and bottom surfaces, said front log being supported by said support structure such that said bottom surface of said front log is spaced above said base plate approximately 1" to define a first elongated generally horizontal chamber section;

a second artificial log of refractory material having front, rear, top and bottom surfaces, said second log being supported by said support structure such that said bottom surface of said second log is proximal said base plate and said front surface of said second log is spaced from said rear surface of said front log between approximately 0.5" and 1.5" to define a second elongated generally vertical chamber section, said first and second chamber sections collectively defining an elongated heat chamber having an angled cross-section;

said logs disposed generally horizontally and parallel to each other and to the plane of the opening of the fireplace;

gas burner means supported by said support structure extending along and in front of said front log for directing blue flame jets into said first elongated chamber section toward said second log for heating to a visible glow said bottom and rear surfaces of said front log, said front surface of said second log, and said base plate, whereby substantial heat is radiated to the surroundings and an appearance of glowing logs and underlying embers is provided to enhance the aesthetics of the artificial log fireplace;

first neat gas burner means for issuing flame jets directed upwardly and rearwardly toward said front surface of said second log to enhance the realism of the fireplace assembly, whereby the radiant heat from said elongated heat chamber enhances the efficiency of combustion of the gas from said neat gas burners;

elongated, horizontally disposed front burner means located proximal said front surface of said front log for causing said front surface of said front log to visibly glow and thereby enhance the realism of the fireplace;

a third artificial log of refractory material having front, rear, top and bottom surfaces disposed generally horizontally and parallel to said front and second logs, said third log being supported by said support surface such that said front surface of said third log is spaced rearwardly from said rear surface of said second log a distance of between approximately 1" and 1.5"; and second neat gas burner means for issuing flame jets generally upwardly disposed between said second and third logs to enhance the realism of the fireplace assembly.

14. The fireplace assembly as recited in claim 13 wherein said bottom surface of said front log and said upper surface of said base plate converge in a direction toward said second log to channel the heat and combustion products from said main burner into said elongated heat chamber.

15. The fireplace assembly as recited in claim 14 wherein the flame jets issuing from said first neat gas burners impinge upon said front surface of said second log in a generally tangential direction at the approximate midpoint of said front surface to provide the appearance of said second log burning.

16. The fireplace assembly as recited in claim 15 wherein said base plate is angled rearwardly and upwardly at a relatively small angle to the horizontal plane to position said top surface of said third log at a higher vertical level than said top surface of said second log, which is in turn positioned at a higher vertical level than said top surface of said front log such that front, second and third logs are visible from the front of a fireplace and give the appearance of a stacked array of horizontal logs.

17. The fireplace assembly as recited in claim 1, 4 or 13 wherein said upper surface of said base plate is a highly-textured ceramic fiber material which enhances the realism of the fireplace by giving the appearance of burning embers underlying logs when it is heated to a visible glow by said gas burner means.

18. The fireplace assembly of claim 1, 4 or 13 wherein said base plate and said logs are made of an inorganic alumina silicate fiber material which glows visibly above about 1470° F.

19. The fireplace assembly of claim 1, 4 or 13 wherein said base plate and said logs are made of an inorganic alumina silicate fiber material which glows visibly when heated to a temperature between approximately 1470° F. and 2030° F.

* * * * *